US006843674B1

(12) United States Patent
Young

(10) Patent No.: US 6,843,674 B1
(45) Date of Patent: Jan. 18, 2005

(54) METHOD AND APPARATUS FOR CONNECTING SERIAL ATA STORAGE COMPONENTS

(75) Inventor: J. Pat Young, Laguna Niguel, CA (US)

(73) Assignee: Silicon Image, Inc., Sunnyvale, CA (US)

( * ) Notice: Subject to any disclaimer, the term of this patent is extended or adjusted under 35 U.S.C. 154(b) by 55 days.

(21) Appl. No.: 10/162,046

(22) Filed: Jun. 3, 2002

(51) Int. Cl.[7] ..... H01R 13/64
(52) U.S. Cl. ..... 439/248; 439/545
(58) Field of Search ..... 439/545, 247, 439/248, 552

(56) References Cited

U.S. PATENT DOCUMENTS 5,049,092 A * 9/1991 Takano et al. ..... 439/540.1
5,514,000 A * 5/1996 Krause et al. ..... 439/248
5,820,388 A 10/1998 Walden
6,012,927 A 1/2000 Longueville et al.
6,030,242 A * 2/2000 Cunningham et al. ..... 439/247
6,052,278 A * 4/2000 Tanzer et al. ..... 361/685
6,077,130 A 6/2000 Hughes et al.
6,089,904 A 7/2000 Wu
6,152,742 A 11/2000 Cohen et al.
6,331,122 B1 12/2001 Wu
6,347,950 B1 2/2002 Yokoyama et al.
6,453,550 B1 9/2002 Farnworth et al.
6,494,749 B1 * 12/2002 Chang ..... 439/701

* cited by examiner

*Primary Examiner*—Ross Gushi
(74) *Attorney, Agent, or Firm*—Perkins Coie LLP

(57) ABSTRACT

A method for connecting to an SATA storage component includes a chassis having an interior and an exterior, and a wall portion provided with an opening. An SATA compatible connector, provided with a first restraining flange and a second restraining flange spaced from the first restraining flange, is inserted into the opening in the wall portion, wherein an interior surface of the first restraining flange faces a first surface of the wall portion and an interior surface of the second restraining flange faces a second surface of the wall portion. An SATA storage component is then inserted into the chassis such that it connects with the SATA compatible connector, whereby the first and second flange allows the SATA compatible connector to float in a limited fashion within the opening.

6 Claims, 16 Drawing Sheets

METHOD AND APPARATUS FOR CONNECTING SERIAL ATA STORAGE COMPONENTS

FIELD OF THE INVENTION

The present invention relates to storage component connectors in a multi-storage component environment and more particularly to serial ATA storage component connectors in a multi-storage component environment.

BACKGROUND OF THE INVENTION

Banks, hospitals, government institutions, public institutions and similar entities often employ multi-storage component systems to manage their data. Due to the importance of the data, it can not be lost under any circumstances, for example, due to a hard disk drive failure. FIG. 1 illustrates a prior art system 10 for managing data in a multi-storage component environment. A RAID (redundant array of inexpensive disks) controller 30 manages data sent to and from multiple storage units (not shown) via a host connection 40, connected to a PC or host server 20. The host connection 40 can be of several different types including SCSI (small computer system interface), fibre channel, ethernet and firewire (IEEE standard 1394). The RAID controller 30, available from CMD Technology Inc. of Irvine, Calif., distributes data mathematically over several storage components in a striping arrangement. If one storage component fails to function properly, the RAID controller 30 prevents the loss of data stored on the failed storage component.

FIG. 2 illustrates a more detailed view of prior art system 10 for managing data in a multi-storage component environment, excluding the host server 20. A backplane 50 (also referred to as a midplane) is used to connect storage components 60 to RAID controller 30, host connection 40 and power supplies 50. Typically, the host connection 40 is a SCSI or fibre channel type since they allow multiple storage components to be connected to a host server 20, up to 125 storage components for fibre channel and up to 14 storage components in the case of SCSI.

While the SCSI and fibre channel standards support multi-storage system environments, the associated SCSI and fibre channel storage components are four to six times more expensive than the traditional IDE (integrated device electronics) storage components that are used in most PC's. The IDE standard only supports the connection of two IDE storage components, however, and is therefore not ideal for use in a multi-storage component environment.

Serial ATA (advanced technology attachment) is the next generation standard replacement for IDE. Serial ATA storage components are similar in cost to IDE storage components. Due to its low cost, it is desirable to use SATA storage components in a multi-storage component environment. However, serial ATA is a relatively new standard, and therefore serial ATA storage components can not simply be modified to work in a multi-storage component environment. One issue that needs to be considered is defining a mechanical attachment which enables a serial ATA storage component to be mounted and connected in a multi-storage environment. Also, the serial ATA standard requires tight impedance control for on board signal routes and as a result serial ATA storage components can not simply be plugged into a circuit board substrate due to potential distortion.

Some other reasons why serial ATA is being implemented include that it has a low pin count, supports lower operating voltages, higher data transfer rate as compared to IDE and the cables are much thinner/flexible.

Another problem of prior art system 10, unrelated to serial ATA, is that the use of a backplane 50 is not ideal. It tends to be bulky and as a result takes up considerable space. Additionally, since component location is fixed due to the use of plug-in boards, system design is constrained.

Accordingly, what is needed is a method to use serial ATA storage components in a multi-storage component environment that defines an appropriate mechanical attachment without the use of plug-in boards. Additionally, it would be desirable to eliminate the backplane.

SUMMARY OF THE INVENTION

The present invention provides a method and apparatus for directly connecting serial ATA storage components. The present invention defines a custom interface for a serial ATA storage component to plug into and a double restraining flange (or "float") on one end of a serial ATA connector that allow the use of serial ATA storage components in a multi-storage component environment. The custom interface and the double restraining flange can be used interchangeably. Advantageously, either approach eliminates the use of a backplane by using serial ATA cables.

A method for connecting to an SATA storage component, in accordance with the present invention, includes a chassis having an interior and an exterior, and a wall portion provided with an opening. An SATA compatible connector, provided with a first restraining flange and a second restraining flange spaced from the first restraining flange, is inserted into the opening in the wall portion, wherein an interior surface of the first restraining flange faces a first surface of the wall portion and an interior surface of the second restraining flange faces a second surface of the wall portion. An SATA storage component is then inserted into the chassis such that it connects with the SATA compatible connector, whereby the first and second flange allows the SATA compatible connector to "float" in a limited fashion within the opening.

A method for connecting an SATA storage component, in accordance with the present invention, includes a chassis having an interior and an exterior, and a wall portion provided with an opening receptive to a plug coupled to an SATA cable. The plug is inserted into the opening and the SATA storage component is connected to the plug on the interior side of the chassis.

In another aspect of the present invention, a system for connecting SATA storage components in a multi-storage component environment includes a chassis with multiple bays each receptive to at least one SATA storage component. A wall portion is provided with an opening receptive to a connection means which is one of a plurality of connection means wherein a first side of the connection means is adapted to couple with an SATA storage component. Also, a plurality of SATA cables are coupled to a second side of the plurality of connection means.

An advantage of the present invention is that it allows serial ATA storage components to be used in a multi-storage component environment which results in an immediate cost savings since traditional SCSI and fibre channel storage components are four to six times more expensive. Additionally, since standard serial ATA cables are employed instead of a circuit board substrate, impedance control is maintained. Also, the backplane is eliminated and as a result, system design can be more compact and flexible.

These and other advantages of the present invention will become apparent to those skilled in the art after reading the following descriptions and studying the various figures of the drawings.

DETAILED DESCRIPTION OF THE INVENTION

Figure 1:
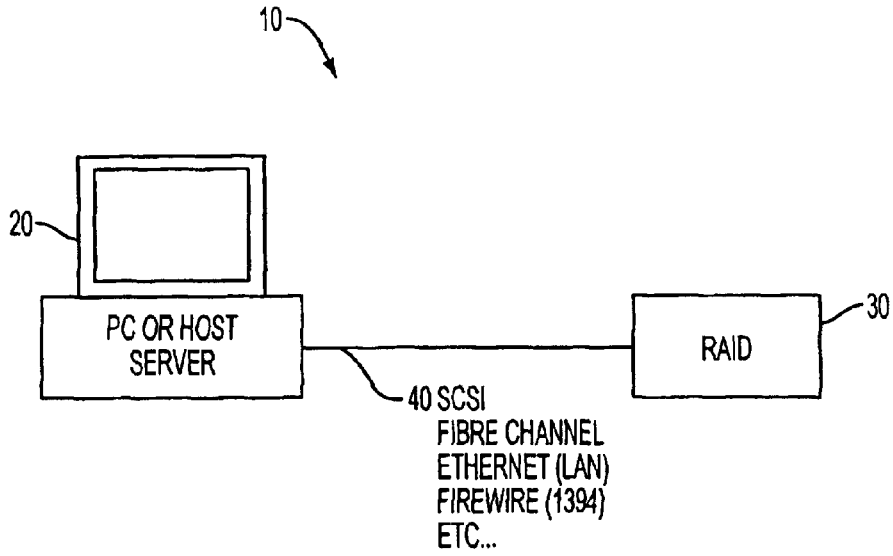
FIG. 1 PRIOR ART
FIG. 1 illustrates a prior art system for managing data in a multi-storage component environment.
Figure 2:
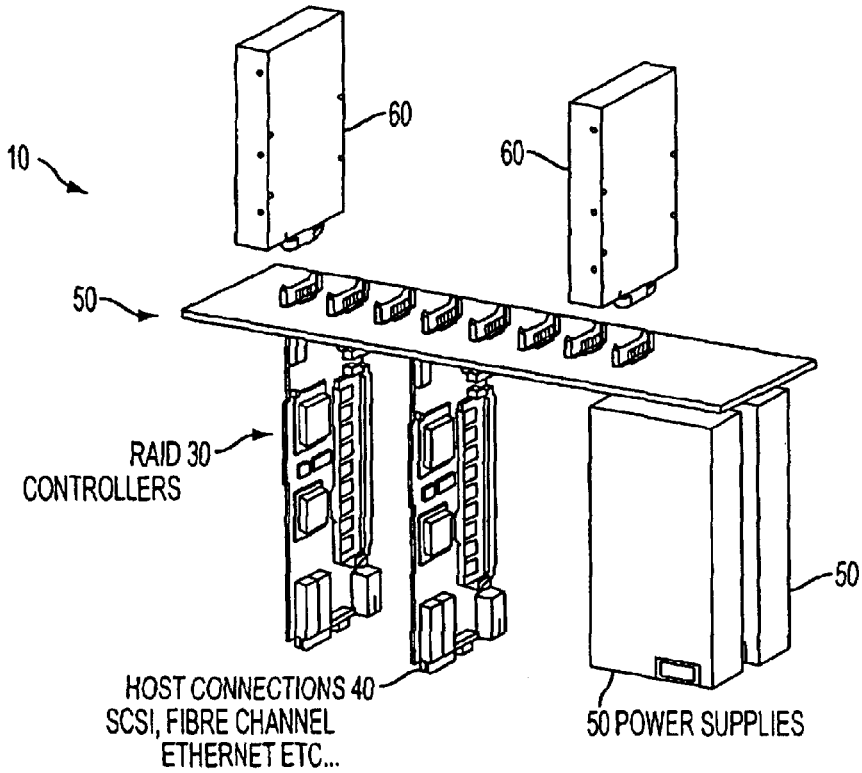
FIG. 2 PRIOR ART
FIG. 2 illustrates a detailed view of a prior art system for managing data in a multi-storage component environment, excluding a host server.
Figure 3:
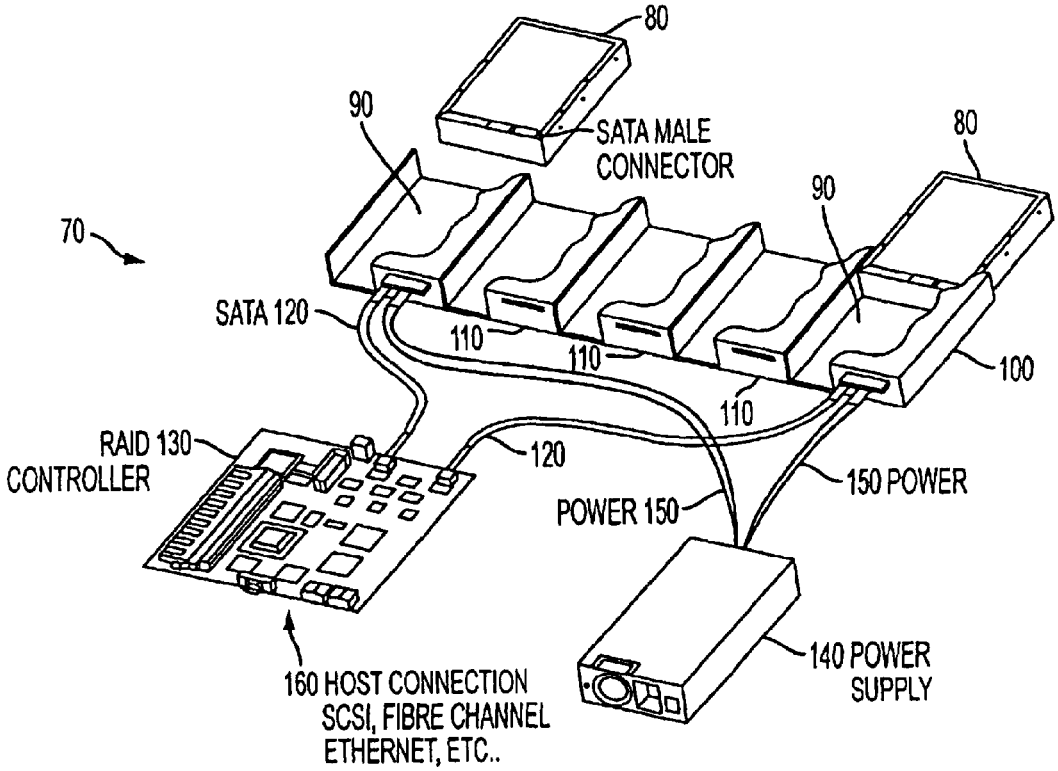
FIG. 3 illustrates a multi-storage component environment utilizing serial ATA storage components in accordance with the present invention.

FIGS. 1 and 2 were described with reference to the prior art. FIG. 3 illustrates a multi-storage component environment 70 utilizing serial ATA storage components 80 in accordance with the present invention. In the context of the present invention, it should be understood that the phrase "serial ATA" and the term "SATA" both describe the serial ATA standard and can be used interchangeably. SATA storage components 80 may be placed into bays 90 of chassis 100. Preferably at the end of each bay 90, there is an opening 110 that is receptive to a specialized connector of an SATA cable 120. The other end of the SATA cables 120 plug into RAID controller 130. A power supply 140 is also preferably connected to the SATA storage components 80 via power cables 150. RAID controller 130, as described in more detail subsequently, regulates the flow of data to and from the SATA storage components 80 to a host computer via host connection 160. Host connection 160 can be of varying standards such as SCSI, fibre channel and ethernet.

Figure 4:
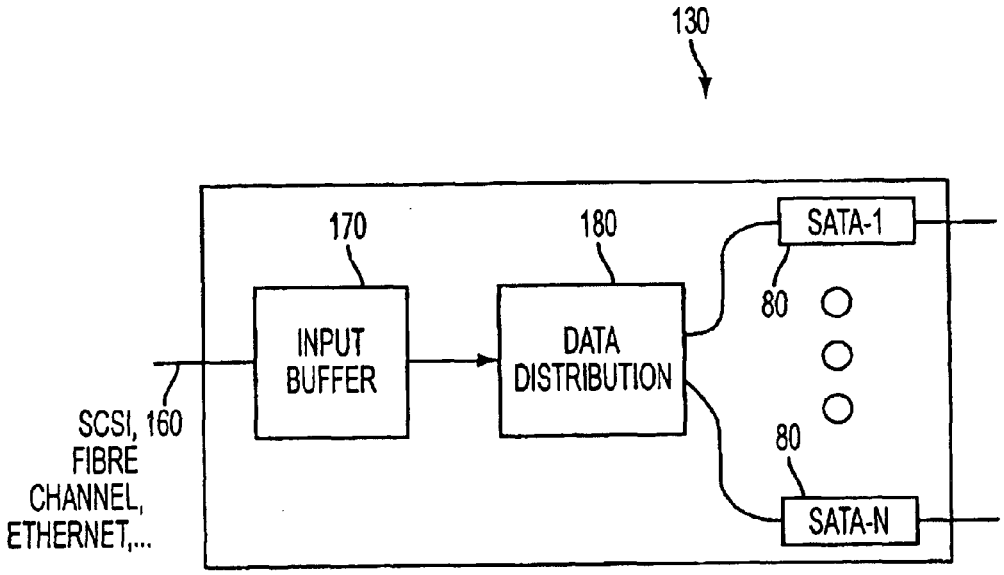
FIG. 4 illustrates a detailed view of a RAID controller in accordance with if the present invention.

FIG. 4 illustrates a detailed view of a RAID controller 130 in accordance with the present invention. Data is communicated to the RAID controller 130 via host connection 160. Data is received at input buffer 170 and is distributed to SATA storage components 80 via a data distribution component 180. As will be appreciated by those skilled in the art, input buffer 170 can be a standard, high impedance input buffer and distribution component 180 can be achieved by a multiplexer, an electronic switch or similar device.

Figure 5A:
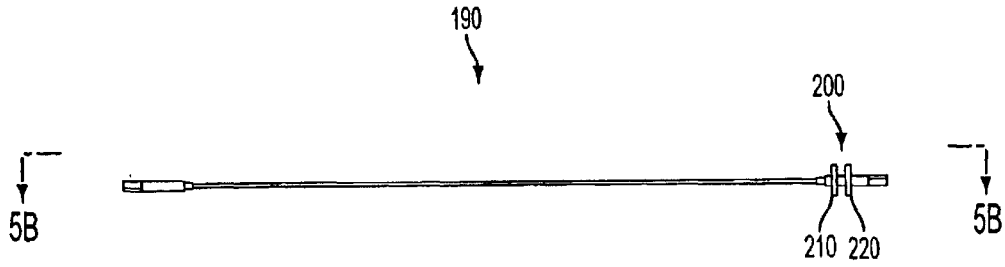
FIG. 5A illustrates an elevation view of a modified serial ATA cable in accordance with the present invention.
Figure 5B:
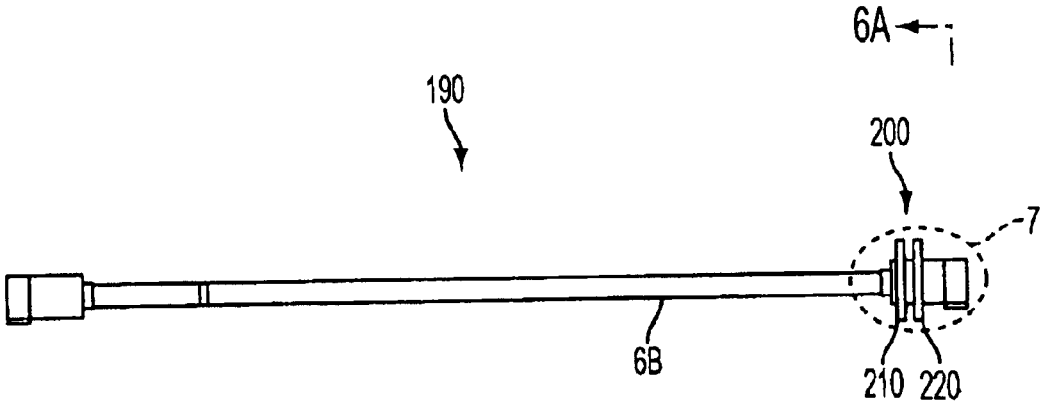
FIG. 5B illustrates a plan view of a modified serial ATA cable taken along line 5*b*—5*b* of FIG. 5A.

FIG. 5A illustrates an elevation view of a modified serial ATA cable 190 in accordance with the present invention. FIG. 5B illustrates a plan view of a modified serial ATA cable 190 taken along line 5*b*—5*b* of FIG. 5A. Modifying a connector 200 (as explained below) of SATA cable 190 is one preferred embodiment of the present invention for connecting SATA storage components in a multi-storage component. The connector 200 is modified by providing a first restraining flange 210 and second restraining flange 220 adapted to fit into opening 110 of chassis 100 such that the interior sides of first and second restraining flanges 210, 220 rest adjacent to the interior and exterior sides of opening 110. The opening 110 is sized to be larger than the body of the connector 200, but smaller than the flanges 210 and 220. As a result, the flanges 210 and 220 cause the connector 200 to be loosely held within the opening 110 such that it tends to "float" within the somewhat larger opening 110, yet restrained by the flanges 210 and 220. Typically the restraining flanges are made out of the same material as the, connector 200 of the SATA cable 190 and can typically be a PVC material. The modified connector 200 can be made by a variety of techniques, included injection molding. An advantage of the small amount of "float" provided by the described amount of "float" provided by the described design is that SATA storage components can be more easily engaged with the connectors. If the connectors were rigidly attached, there would have to be a nearly perfect alignment between a modified SATA connector and a mating SATA connector on the SATA storage component. The "float" allows the modified SATA connector to adjust to the position of the mating connector, thereby self-aligning the two connectors.

Figure 6A:
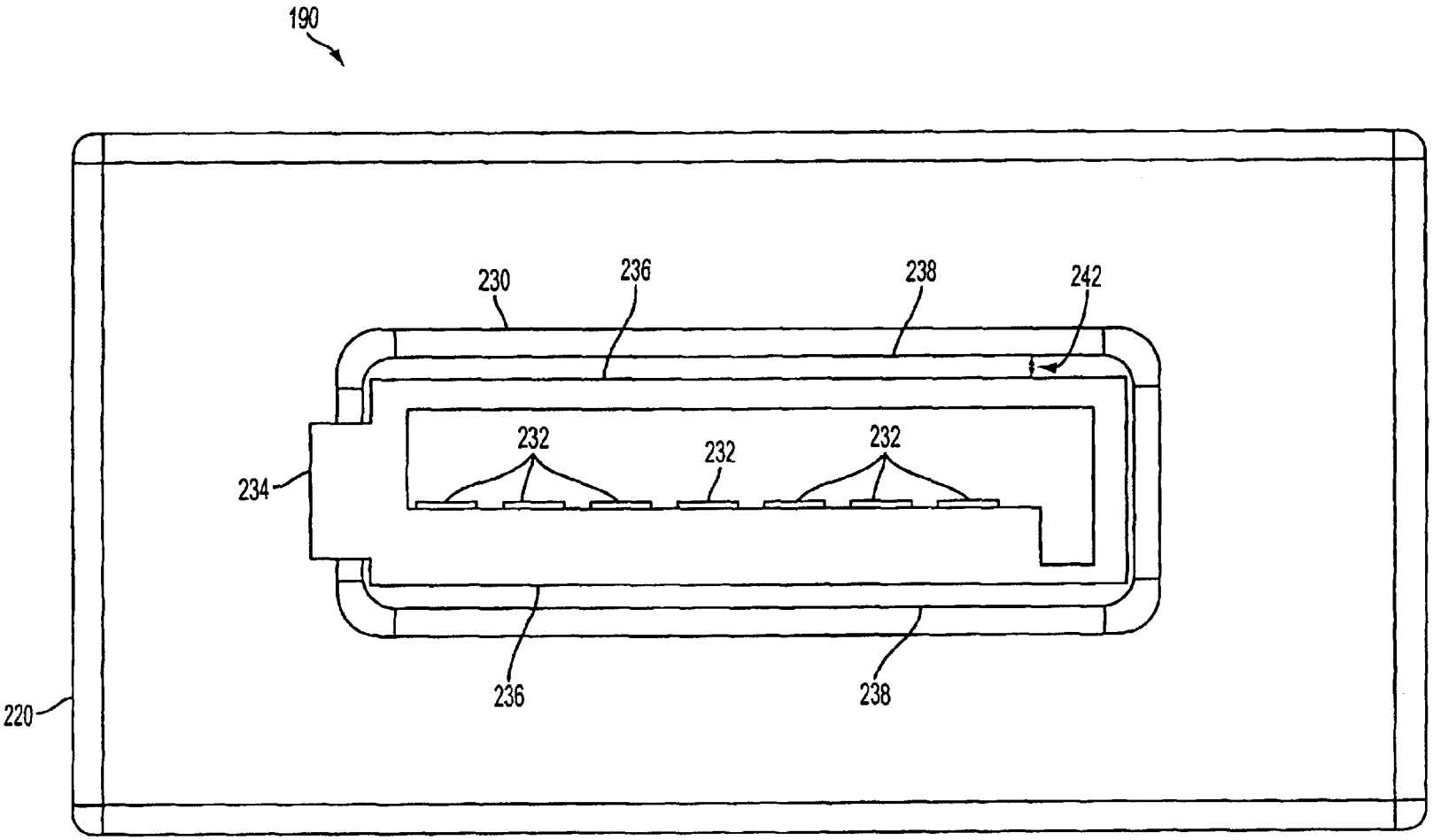
FIG. 6A illustrates an elevation view of a connector of a modified serial ATA cable as seen along line 6A—6A of FIG. 5B.

FIG. 6A illustrates an elevation view of a connector end 200 of a modified serial ATA cable as seen along line 6A—6A of FIG. 5B. The exterior of restraining flange 220 is shown. Female connector end 230 is adapted to engage a mating connector of a SATA storage component 80. The material for the contacts 232 are preferably in accordance with table 1, which is from the serial ATA specification, version 1, incorporated herein by reference.

TABLE 1

| PARAMETER | RECOMMENDATION | COMMENTS |
|---|---|---|
| MATERIAL | Copper alloys, for example, brass for plug contacts and phosphor bronze for receptacle contact, the spring. | Material temper and thickness should be selected based on normal force and elastic deflection range consideration. |
| MATING SIDE PLATING | For 50 durability cycles: −1.27 μm minimum Ni with either 0.38 μm minimum Au or 0.38 μm minimum 80/20 Pd/Ni with 0.051 μm minimum Au flash. For 500 durability cycles: −1.27 μm minimum Ni with either 0.76 μm minimum Au or 0.76 μm minimum 80/20 Pd/Ni with 0.051 μm minimum Au flash. | Exposed underplate or base material is not allowed in the mating area. |

TABLE 1-continued

| PARAMETER | RECOMMENDATION | COMMENTS |
|---|---|---|
| SOLDER SIDE PLATING | Either Sn/Pb plating or Pd/Ni with Au flash: −1.27 μm minimum Ni with 3.18 μm minimum Sn/Pb. Or −1.27 μm minimum Ni with 0.76 μm minimum 80/20 Pd/Ni with 0.51 μm minimum Au flash. | Exposed base material is allowed in small areas where the contact is excised from its carrier strip or bandolier. |

Figure 6B:
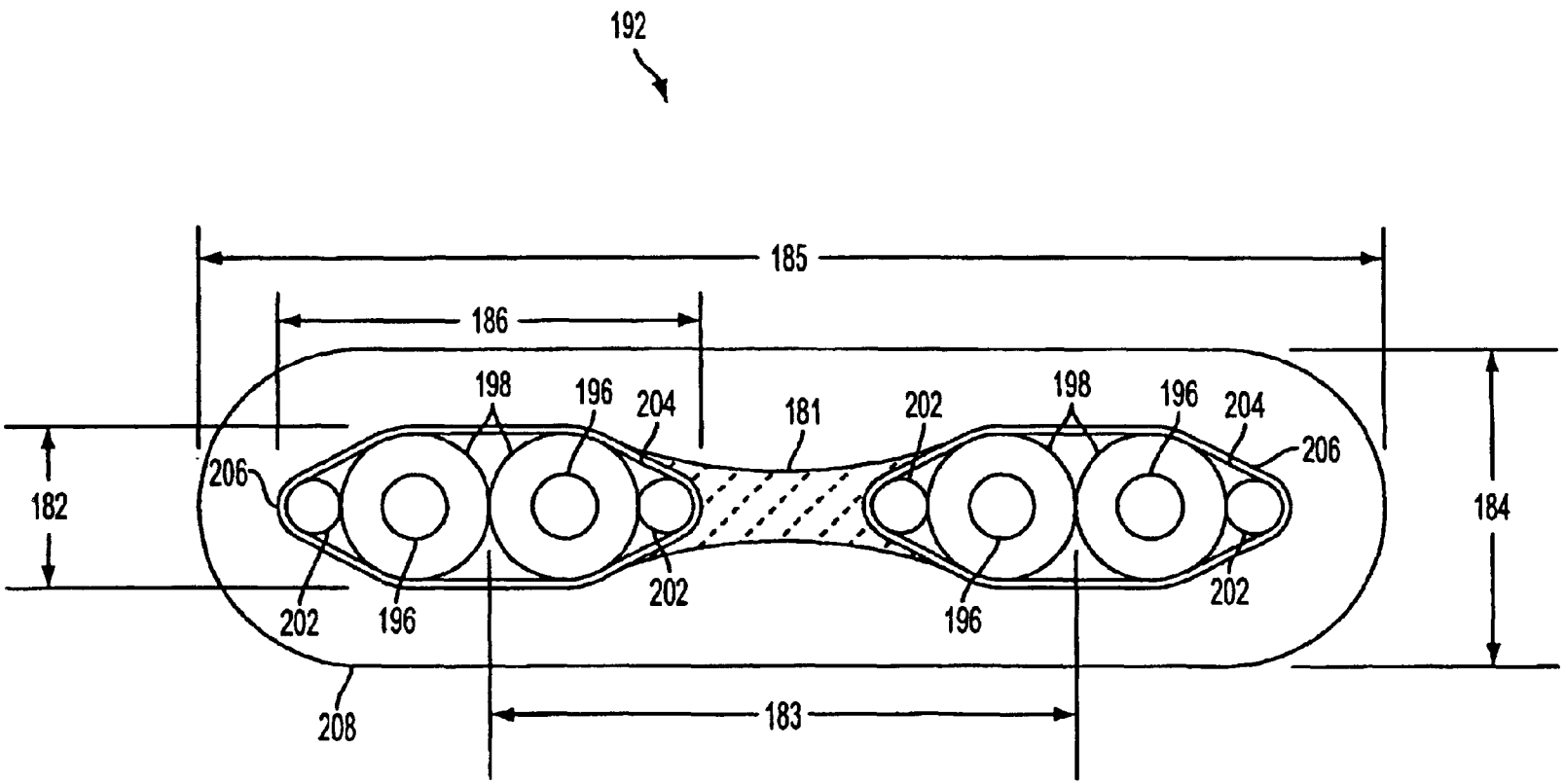
FIG. 6B illustrates a cross-section of an example SATA cable taken at point 6B in the direction of line 6A—6A as shown in FIG. 5B.

FIG. 6B illustrates a cross-section of an example SATA cable taken at point 6B in the direction of line 6A—6A as shown in FIG. 5B, preferably in accordance with table 2, both of which are also from the serial ATA specification, version 1. Shielded wire pairs 196 can be constructed out of 26 AWG solid tinned copper or the like (American Wire Gauge—a system commonly used for describing the size of copper wire. It is based on the circular mil system in which 1 mil equals 0.0254 mm or 25.4 microns.) The shielded wire pairs 196 are preferably surrounded by a white foam polyolefin 198. Additionally, parallel pairs 202 are constructed out of 28 AWG solid tinned copper or the like. Each set of shielded wire pairs 196, white foam polyolefin 198 and parallel pairs 202 are preferably all surrounded by an aluminized polyester foil layer 204. Both sets of shielded wire pairs 196, white foam polyolefin 198, parallel pairs 202 and aluminized polyester foil layer 204 are preferably surrounded by a heat-sealed longitudinal wrap 206. Jacket 208 surrounds the heat sealed longitudinal wrap 206 is preferably significantly thicker than the wrap 206. Jacket 208 can be made from PVC or the like. Region 181, defined by the dashed lines, can be devoid of material or filled in, though neither state impacts the function of the SATA cable 192. Dimension 182 is in preferably about 0.0465 inches, dimension 183 is preferably about 0.150 inches, dimension 184 is preferably about 0.0865 inches, dimension 185 is preferably about 0.305 inches and dimension 186 is preferably about 0.115 inches.

TABLE 2

| ELECTRICAL | | PHYSICAL |
|---|---|---|
| Impedance: | 100 +/− 5 ohms (differential) | (2) shielded pairs - 26 AWG solid tinned copper |
| Capacitance: | 42 pf/M nominal | 0.0435 inches nominal diameter foam polyolefin, white |
| Propagation delay: | 425 ns/M nominal | Parallel pair with (2) drains - 28 AWG solid tinned copper |
| Skew (within pair): | TBD (TDT method, drains grounded) (differential 50%-50%, Tektronix 11801, SD-24/SD-26 sampling heads) | 0.001 inches aluminized polyester, foil in, 0.035 inches minimum overlap |
| Attenuation (nominal): | TBD db/M @ 4.5 GHz | Blue typical longitudinal wrap, heat sealed Jacket - 0.02 inches nominal wall PVC, red |

Figure 7:
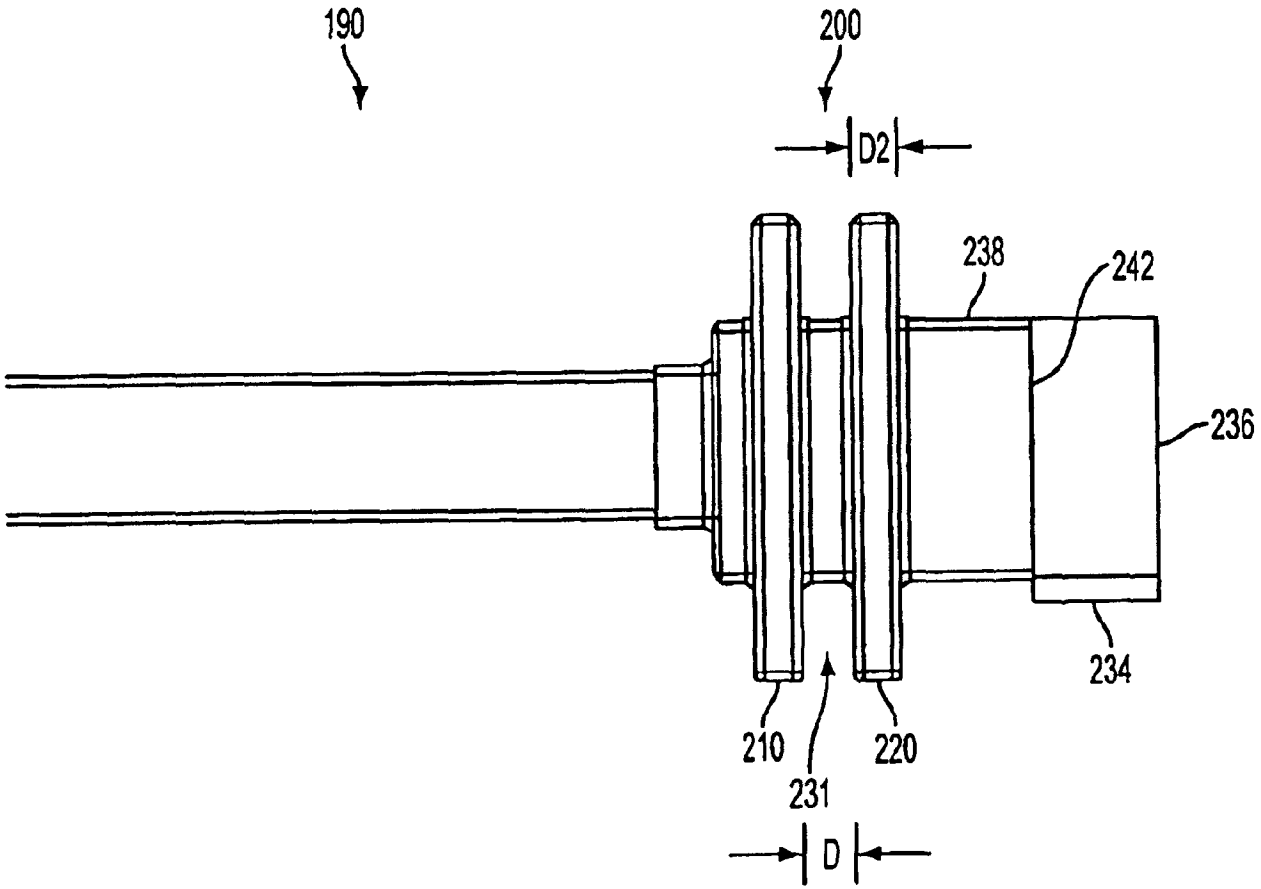
FIG. 7 is an enlarged view of a connector as encircled by broken line 7 as shown in FIG. 5B.
Figure 8:
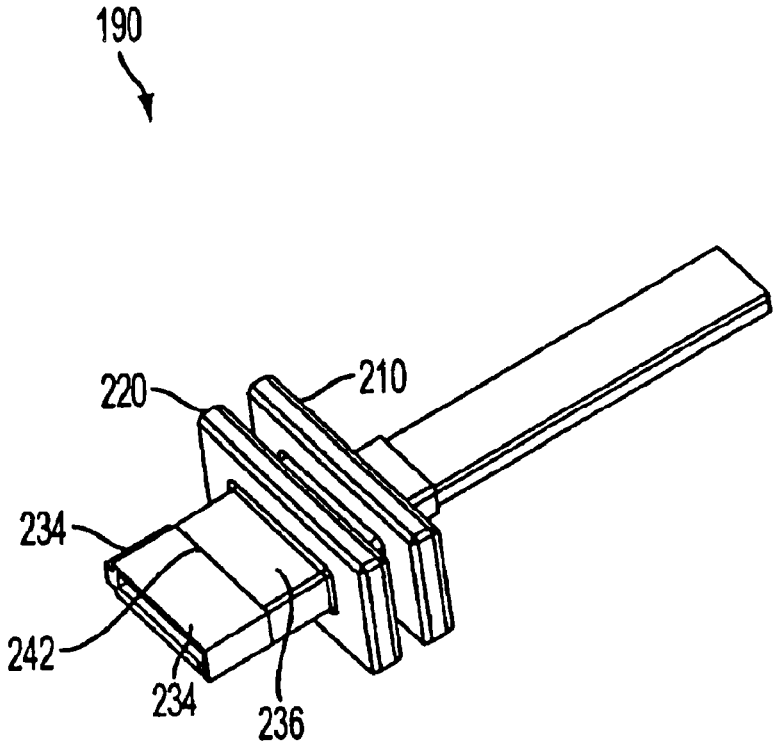
FIG. 8 shows the connector in isometric form.

FIG. 7 is an enlarged view of a connector as encircled by broken line 7 as shown in FIG. 5B. FIG. 8 shows the connector 190 in isometric form. Restraining flange 210 and second restraining flange 220 are separated by a distance "D" which defines a space 231. The distance D is somewhat greater than the thickness of the wall of the bay 90 in which opening 110 is provided. The wall of the bay 90 is preferably about 1.2 mm and can be made out of sheet metal or the like. The distance D provides for the "float", as was previously described. By being somewhat greater than the thickness of the wall of the bay 90, SATA storage components can be more easily engaged with the connectors. If the connectors were rigidly attached, there would have to be a nearly perfect alignment between a modified SATA connector and a mating SATA connector on the SATA storage component. The "float" allows the modified SATA connector to adjust to the position of the mating connector, thereby self-aligning the two connectors. Flanges 210 and 240 are preferably about 0.85 to 1.45 mm thick as shown by distance D2. In a preferred embodiment, D2 is about 1.35 mm.

Referring back to FIG. 6A, connector tab 234, adjacent to connector end 236, ensures a snug fit of the connector/SATA cable 190 with a mating SATA connector on the SATA storage component. Connector tab 234 is slightly thinner than connector end 236. A mating connector on an SATA storage component is formed in a manner such that the opening, on the mating connector, matches the shape of connector end 236 and as a result, a tight connection is established. Additionally, connector end 234 is slightly thinner than connector section 238. This results in a step 242 at the boundary of connector section 238 and connector end 234. A mating connector on an SATA storage component is also formed in a manner that the opening matches the shape of the connector end 234 in combination with the connector tab 232. The step 242 functions as a stop-guide because once the step 242 is flush with a mating connector on an SATA storage component, the SATA cable 190 is fully in contact with an SATA storage component.

Figure 9A:
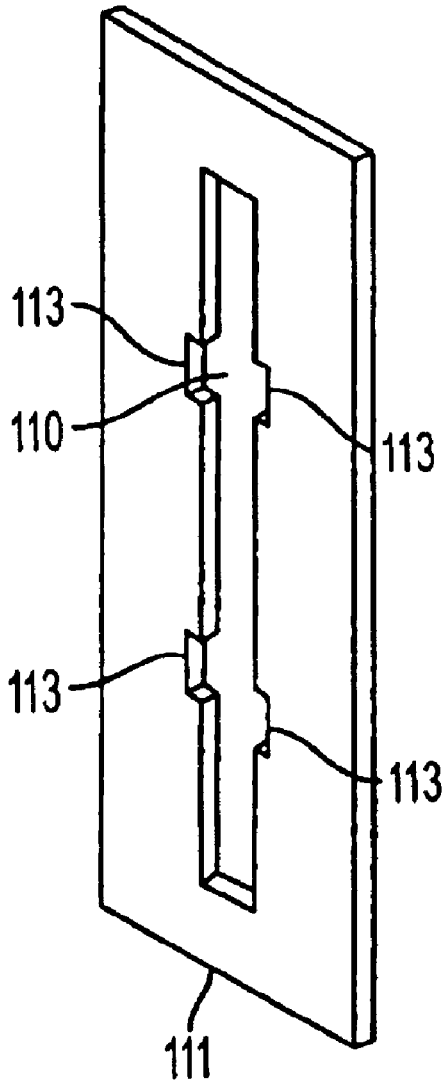
FIG. 9A is an isometric view of an opening in a wall portion, at one end of a bay (not shown) in a chassis (not shown) receptive to a modified connector of the present invention.
Figure 9B:
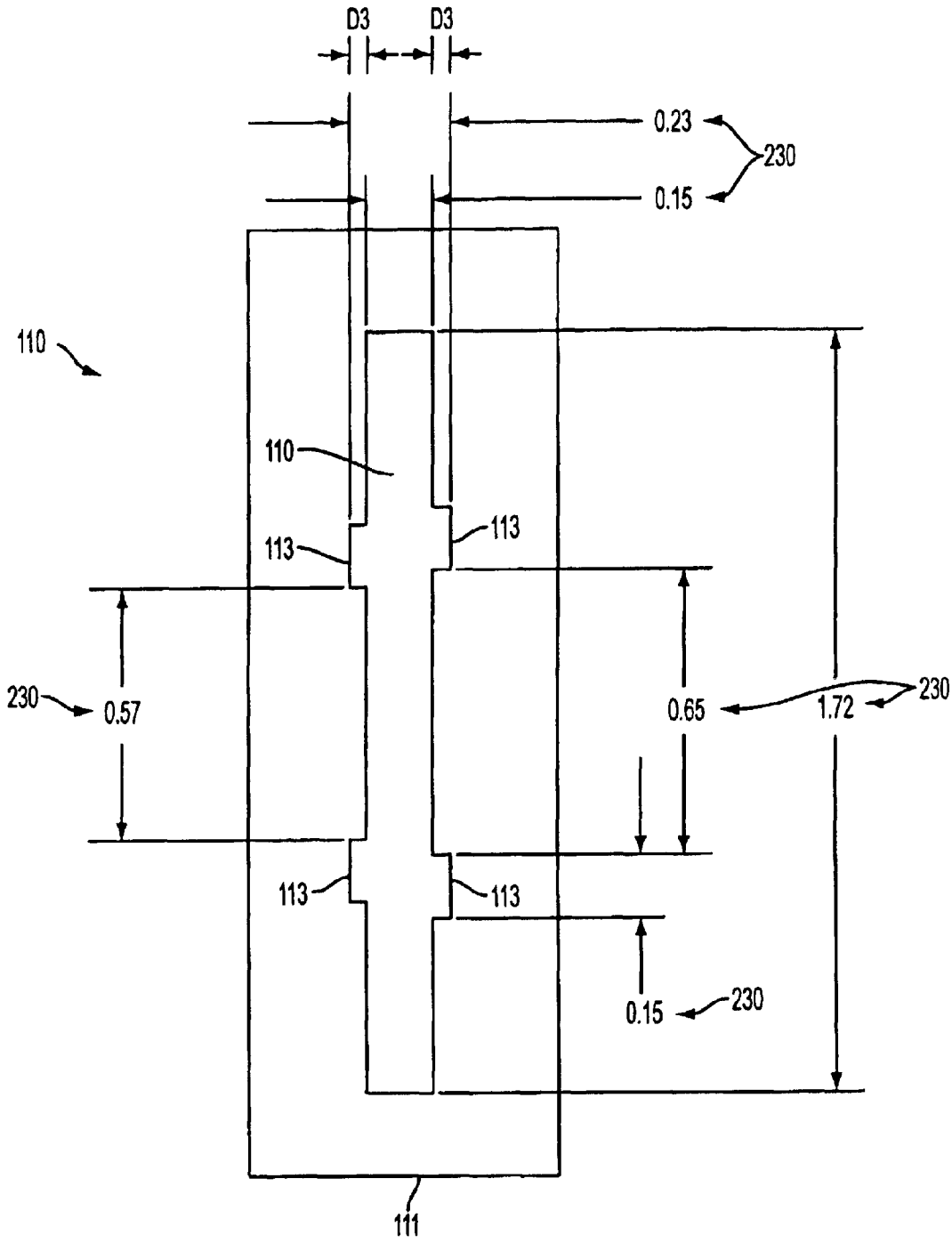
FIG. 9B illustrates a plan view of an opening in a chassis receptive to a plug in accordance with the present invention.

FIG. 9A is an isometric view of an opening 110 in a wall portion 111, at one end of a bay 90 (not shown) in a chassis 100 (not shown) receptive to a plug (not shown) of the present invention. FIG. 9B illustrates a plan view of an opening 110 in a chassis receptive to a plug, also in accordance with the present invention. Opening 110 illustrates a second method for connecting SATA storage components in a multi-storage component environment. A plug, as will be shown subsequently, fits into opening 110 and is held in place by snapping into slots 113. SATA storage components then connect to one side of the plug and an unmodified SATA cable and a power cable connect to the other side of the plug. In a preferred embodiment, the SATA cable is permanently attached to the plug. Dimensions 230 are in units of millimeters. The height of the slots 113 is preferably about 0.6 to 1.0 mm, as shown by distance D3. In a preferred embodiment, the slots 113 are about 0.8 ml.

Figure 10A:
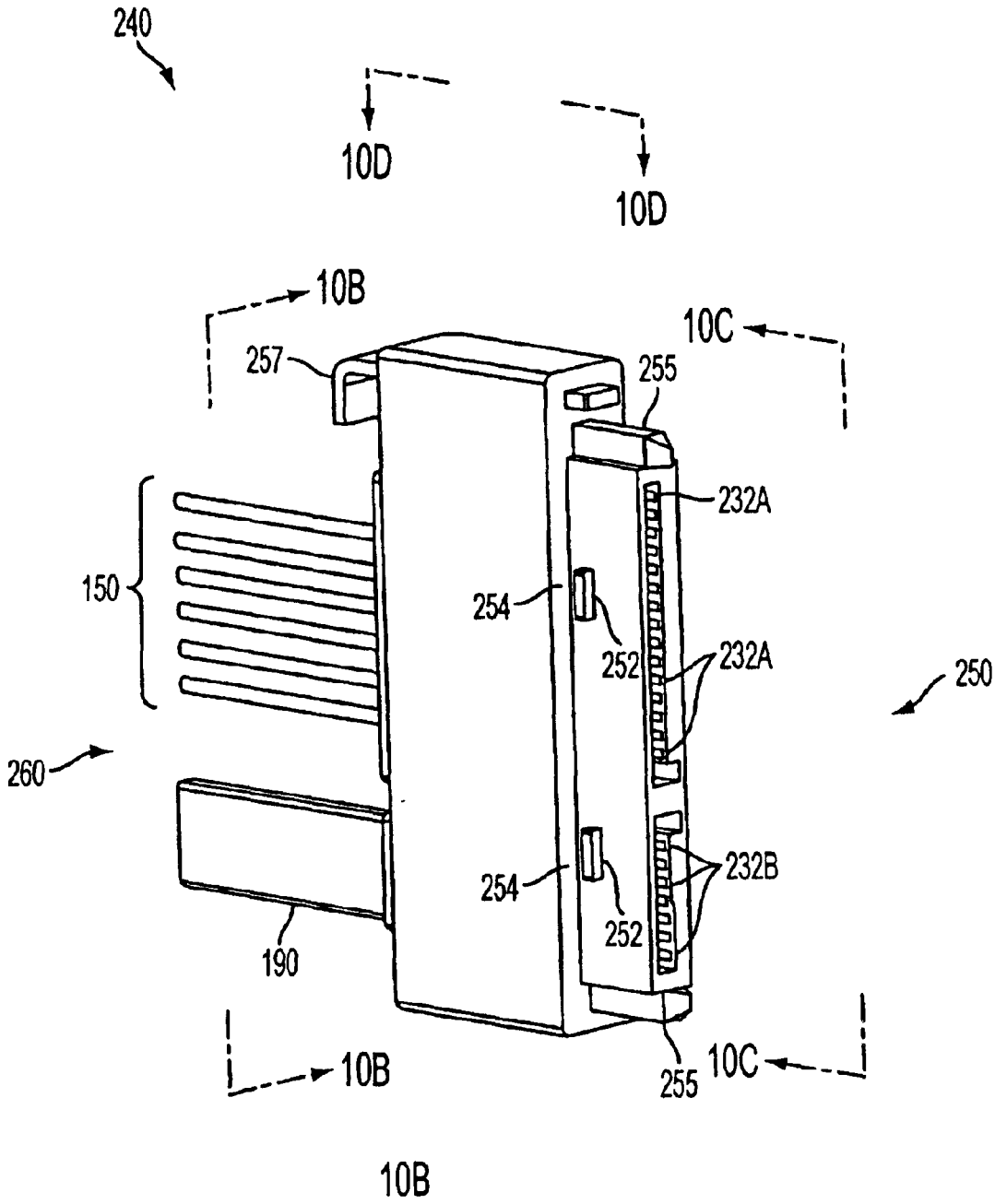
FIG. 10A illustrates an isometric view of a plug in accordance with the present invention.
Figure 10B:
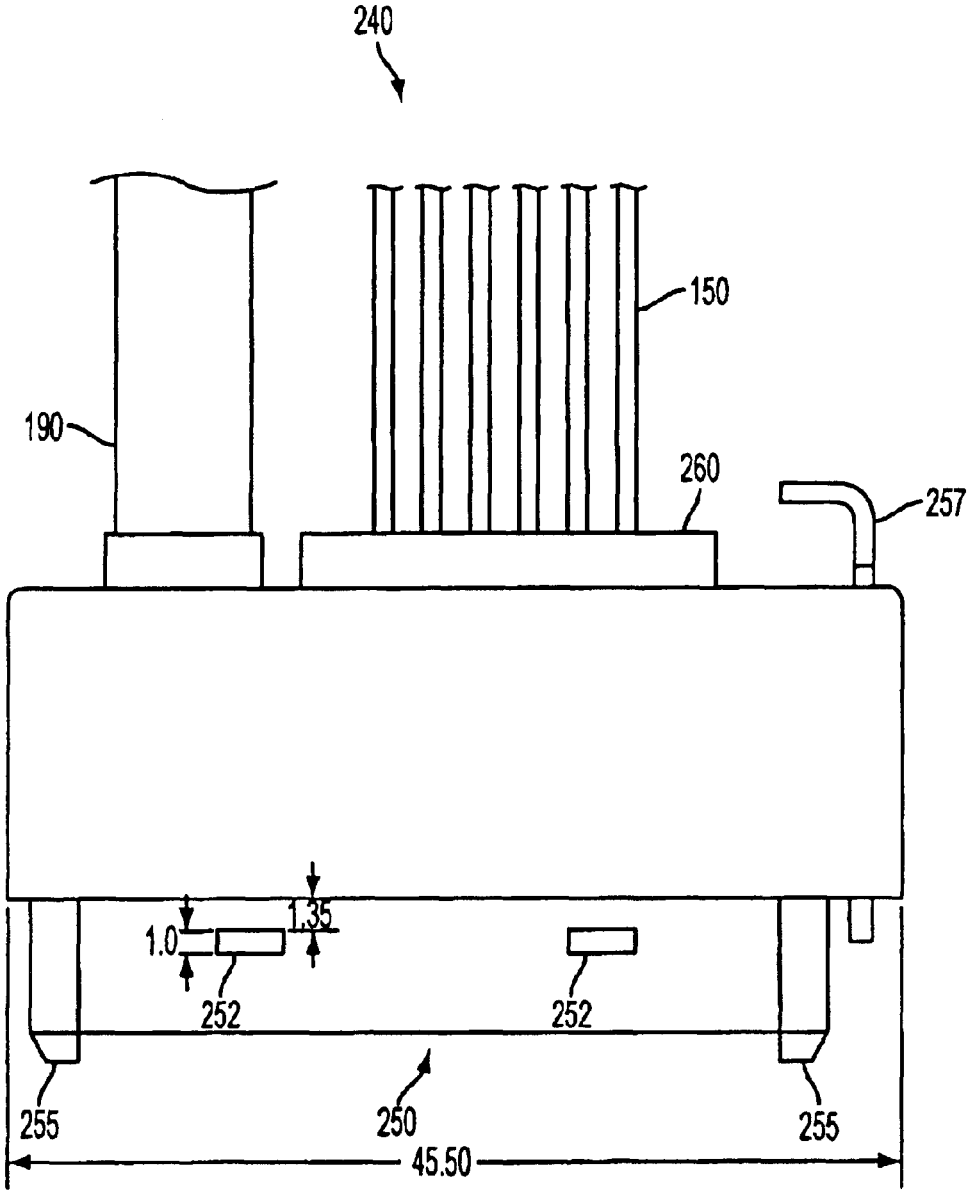
FIG. 10B illustrates a plan view of a plug taken along line 10B—10B as shown in FIG. 10A.

FIG. 10A illustrates an isometric view of a connector 240 in accordance with the present invention. Interior end 250 connects to an SATA storage component 80 (not shown). Exterior end 260 connects to an SATA cable 190 and power cable 150. SATA contacts 232A correspond to SATA cable 190 and power contacts 232B correspond to power cable. FIG. 10B illustrates a plan view of a plug 240 taken along line 10B—10B as shown in FIG. 10A. Similar to FIG. 10A, there is an interior end 250, SATA cable 120 and power cable 150. Snaps 252 are spaced in a manner such that they line up with slots 113, defined in opening 110 of wall portion 111. When connector 240 is pushed into opening 110, connector 240 can be guided in until wall portion 111 rests at point 254, on interior sides of snaps 252. Snaps 252 preferably protrude slightly higher than the height of slots 113. This ensures that connector 240 is held in place while residing in opening 110. Push pin 257 is also used to hold connector 240 firmly in place. Push pin 257 has two detents (not shown as they are hidden inside the connector body) that limit the connector to a locked and unlocked position. Once in a locked position, the connector 240 can not be removed from the opening 110 without re-engaging push pin 257. The depicted dimensions are in millimeters.

Figure 10C:
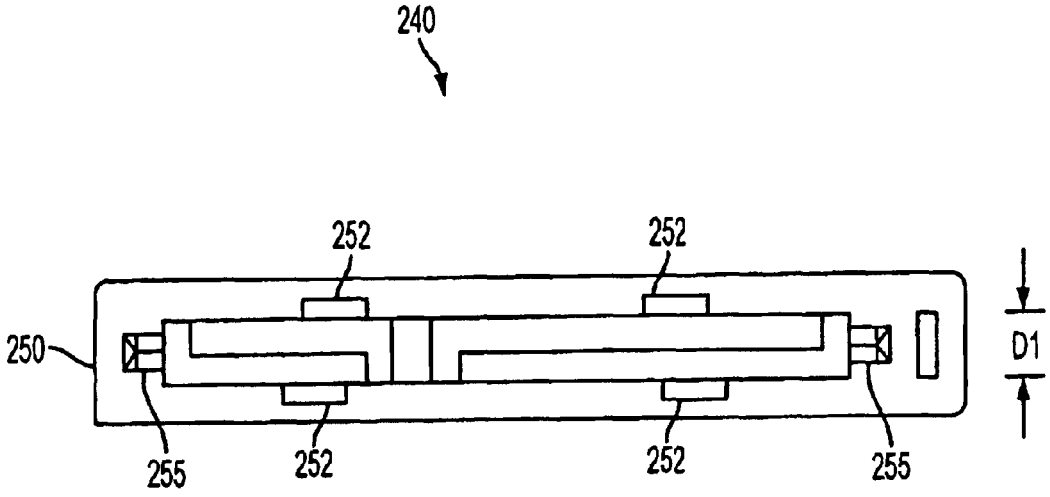
FIG. 10C illustrates an elevation view of a plug taken along line 10C—10C as shown in FIG. 10A.
Figure 10D:
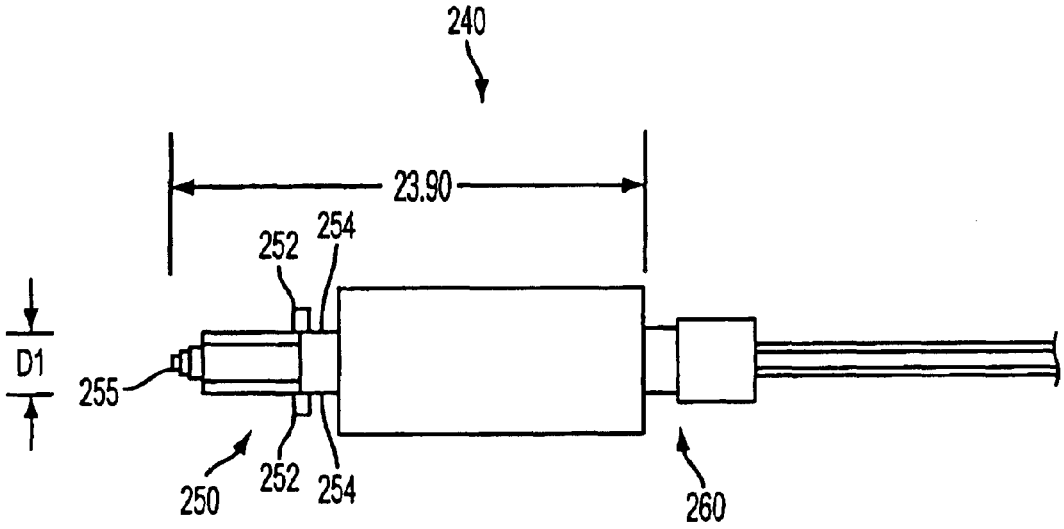
FIG. 10D illustrates a side elevation view of a plug taken in the direction of line 10D as shown in FIG. 10A.

FIG. 10C illustrates an elevation view of a plug 240 taken along line 10C—10C as shown in FIG. 10A. FIG. 10D illustrates a side elevation view of a plug 240 taken in the direction of line 10D as shown in FIG. 10A. As can be seen, snaps 252 are located on both top and bottom sides of connector 240 corresponding to slots 113 of wall portion 111. Guides 255, located on opposite sides of interior end 250, preferably guide the connector 240 into a correct alignment with an SATA storage component. Guides 255 are preferably slightly thinner than distance D1, and preferably have a polygonal ending. A mating connector on a corresponding SATA storage component is shaped so that it corresponds to the shape of guides 255, thus ensuring a proper alignment of the connector 240 and an SATA storage component. Again, the depicted dimensions are in millimeters.

Figure 11:
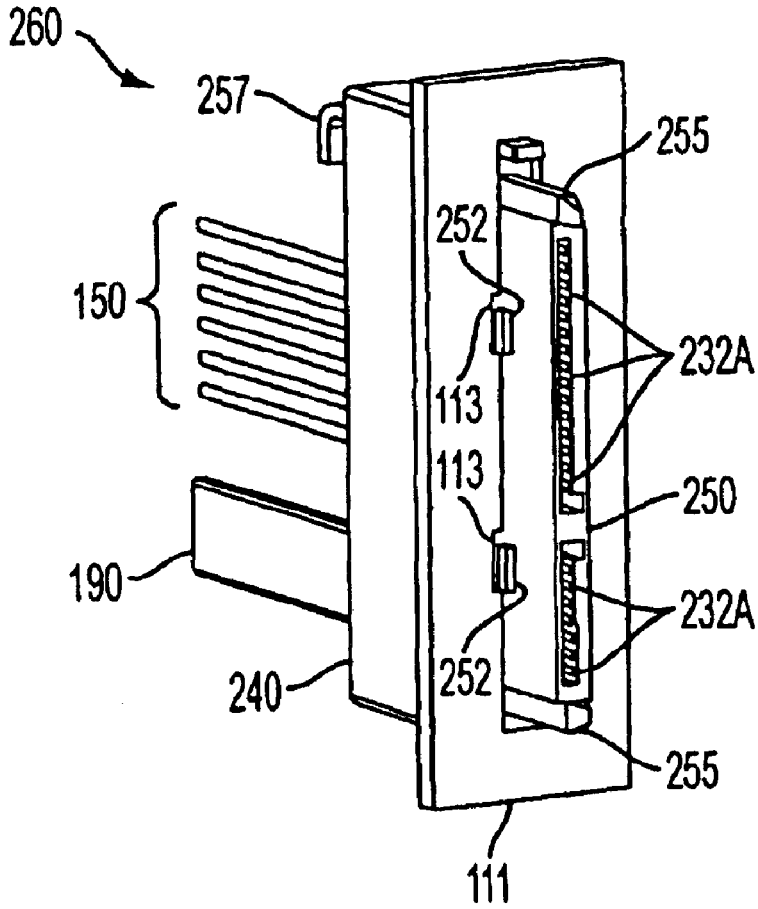
FIG. 11 illustrates a working view of a plug residing in an opening of a chassis in accordance with the present invention.

FIG. 11 illustrates a working view of a plug 240 residing in an opening 110 in a wall portion in accordance with the present invention. Plug 240 is connected into opening 110 in the direction indicated by arrow 260. Once in the proper position, snaps 252 hold plug 240 in place. Once in place, wall portion 111 rests on an interior side of snaps 252. When an SATA storage component is connected to interior end 250 of connector 240, guides 255 ensure proper alignment, as was previously summarized.

In one aspect of the present invention, a system for connecting SATA storage components in a multi-storage component environment includes a chassis with multiple bays each receptive to holding at least one SATA storage component. A wall portion is provided with an opening at one end of each bay receptive to a connection means which is one of a plurality of connection means wherein a first side of the connection means is adapted to couple with an SATA storage component. Also, a plurality of SATA cables are coupled to a second side of the plurality of connection means. The connection means preferably takes the form of a modified SATA cable wherein one end has a first and second restraining flange or float on the circumference of the end of the cable. The SATA cable can then preferably be placed into an opening of a wall of a chassis such that interior sides of the first and second restraining float face an exterior side and an interior side of the wall. In another embodiment, the connection means may preferably be a plug that snaps into place when placed into an opening of a wall portion.

An advantage of the present invention is that it allows serial ATA storage components to be used in a multi-storage component environment which results in an immediate cost savings since traditional SCSI and fibre channel storage components are four to six times more expensive. Additionally, since standard serial ATA cables are employed instead of a circuit board substrate, impedance control is maintained. Also, the backplane is eliminated and as a result, system design can be more compact and flexible.

While this invention has been described in terms certain preferred embodiments, it will be appreciated by those skilled in the art that certain modifications, permutations and equivalents thereof are within the inventive scope of the present invention. It is therefore intended that the following appended claims include all such modifications, permutations and equivalents as fall within the true spirit and scope of the present invention.

What is claimed is:

1. A method for connecting to an SATA storage component comprising:

a chassis having an interior and an exterior, and a wall portion provided with an opening, inserting an SATA compatible connector, provided with a first circumferential restraining flange and a second circumferential restraining flange spaced from the first circumferential restraining flange, into the opening in the wall portion, wherein an interior surface of the first circumferential restraining flange faces a first surface of the wall portion and an interior surface of the second circumferential restraining flange faces a second surface of the wall portion; and inserting an SATA storage component into the chassis such that it connects with the SATA compatible connector, whereby the first and second flanges allow the SATA compatible connector to float in a limited fashion in both a vertical and a horizontal direction within the opening resulting in a self-alignment between the SATA compatible connector and the SATA storage component.

2. The method as recited in claim 1 wherein a thickness of the first circumferential restraining flange and the second circumferential restraining flange is about 0.85 mm to about 1.45 mm.

3. The method as recited in claim 1 wherein a separation between the first circumferential restraining flange and the second circumferential restraining flange is about larger than a thickness of the wall portion.

4. A system for connecting SATA storage components in a multi-storage component environment comprising:

a chassis with multiple bays each receptive to at least one SATA storage component;

a wall portion provided with an opening receptive to a connection means which is one of a plurality of connection means wherein a first side of the connection means is adapted to couple with an SATA storage component wherein the connection means includes a first circumferential restraining flange and a second circumferential restraining flange on an end of each SATA cable wherein an interior surface of the first circumferential restraining flange faces a first surface of the wall portion and an interior surface of the second circumferential restraining flange faces a second surface of the wall portion; and a plurality of SATA cables coupled to a second side of the plurality of connection means whereby the first and second circumferential restraining flanges allow the plurality of connection means to float in a limited fashion in both a vertical and a horizontal direction within the opening resulting in a self-alignment between the SATA cables and the plurality of connection means.

5. The system as recited in claim 4 further comprising:

a controller coupled to the set of SATA cables and operative to control the SATA storage components;

a plurality of power cables coupled to the second side of the plurality of connection means; and a power supply coupled to the plurality of power cables and operative to powering the plurality of SATA storage components.

6. A system for connecting SATA storage components in a multi-storage component environment comprising:

a chassis with multiple bays each receptive to at least one SATA storage component;

a wall portion provided with an opening receptive to a flexible connector which is one of a plurality of flexible connectors wherein a first side of the flexible connector is adapted to be flexibly connected with an SATA storage component wherein the flexible connector includes a first circumferential restraining flange and a second circumferential restraining flange on an end of each SATA cable wherein an interior surface of the first circumferential restraining flange faces a first surface of the wall portion and an interior surface of the second circumferential restraining flange faces a second surface of the wall portion;

a plurality of SATA cables flexibly connected to a second side of the plurality of flexible connectors whereby the first and second circumferential restraining flanges allow the plurality of flexible connectors to float in a limited fashion in both a vertical and a horizontal direction within the opening resulting in a self-alignment between the SATA cables and the plurality of flexible connectors;

a controller flexibly connected to the set of SATA cables and operative to control the SATA storage components via bi-directional signals, a plurality of power cables flexibly connected to the second side of the plurality of connection means; and a power supply flexibly connected to the plurality of power cables and operative to powering the plurality of SATA storage components.

* * * * *